US005140216A

United States Patent [19]

Darr

[11] Patent Number: 5,140,216

[45] Date of Patent: Aug. 18, 1992

[54] EXPLOSION PROOF LAMP WITH LIQUID EXTINGUISHANT

[76] Inventor: David W. Darr, 807 Waters St., Shelby, N.C. 28150

[21] Appl. No.: 200,028

[22] Filed: May 27, 1988

[51] Int. Cl.[5] ..... H01J 61/34

[52] U.S. Cl. ..... 313/25; 313/36; 313/493; 362/22; 362/223

[58] Field of Search ..... 313/493, 25, 36; 362/22, 164 (U.S. only), 223 (U.S. only); 252/8

[56] References Cited

U.S. PATENT DOCUMENTS

| | | | |
|---|---|---|---|
| 562,208 | 6/1896 | Waegel | 362/22 |
| 1,294,806 | 2/1919 | Hunt et al. | 362/22 X |
| 1,918,223 | 7/1933 | Wheat | 362/22 |
| 2,447,922 | 8/1948 | Tuck . | |
| 2,449,362 | 9/1948 | Bell . | |
| 2,760,053 | 8/1956 | Choisser | 362/223 |
| 2,820,761 | 1/1958 | Anthony, Jr. | 252/8 |
| 2,877,341 | 3/1959 | Edgerton | 313/36 X |
| 2,936,387 | 5/1960 | Steele, Jr. et al. | 313/25 X |
| 3,879,297 | 4/1975 | Languille et al. | 252/8 |
| 4,147,495 | 3/1979 | Straitz, III | 431/145 X |
| 4,156,893 | 5/1979 | Baake | 362/164 X |
| 4,287,456 | 9/1981 | Kovacik et al. | 439/239 X |
| 4,606,832 | 8/1986 | Hisamoto et al. | 252/8 |
| 4,622,485 | 11/1986 | Miyashita et al. | 313/25 |
| 4,644,453 | 2/1987 | Vest | 362/223 |

FOREIGN PATENT DOCUMENTS

| | | | |
|---|---|---|---|
| 520896 | 1/1956 | Canada | 362/22 |
| 2310529 | 5/1976 | France . | |
| 2086558 | 5/1982 | United Kingdom . | |

*Primary Examiner*—Palmer C. DeMeo
*Attorney, Agent, or Firm*—W. Thad Adams, III

[57] ABSTRACT

An explosion proof light comprising a shatter-resistant, fluid tight, light transmissive case and a fluid tight light source sealed within the case in at least partial spaced-apart relation thereto. An effective quantity of electrically non-conductive fluid extinguishant such as Halon 2402 is sealed within the space between the case and the light source under positive pressure for suppressing sparks resulting from damage to the light causing penetration to the light source and exposure of sparks and intense heat to the environment. An outer housing may preferably be positioned over the case to add further protection.

8 Claims, 3 Drawing Sheets

EXPLOSION PROOF LAMP WITH LIQUID EXTINGUISHANT

TECHNICAL FIELD AND BACKGROUND OF THE INVENTION

This invention relates to an explosion proof light particularly adapted for use in the presence of flammable vapors. Portable fluorescent hand lamps are well known. Typically, these lights comprise a glass fluorescent tube sealed within a tough, transparent plastic outer case. The glass tube is ideally protected from damage by the plastic outer case. However, these lamps are not explosion proof as required in OSHA standards 29 CFR 1910.303 (b) (1) and 29 CFR 1910.307 (b) and National Electric Code 501-9.

The only portable lights currently approved for Class I hazardous locations are made of machined metal parts with guard and globe assemblies designed to contain an explosion caused by flammable vapors entering the assembly and being ignited by internal heat and sparks. These lamps are weighty and expensive. They also depend solely on the integrity of the guard and globe to contain the explosion. Any failure of these parts is not compensated for by any other components.

The invention described in this application takes advantage of several characteristics of a fluid extinguishant known as Halon 2402. This substance is substantially inert, electrically non-conductive and relatively non-toxic. It instantly extinguishes sparks and prevents combustion in the presence of extreme heat by asphyxiation. It has a boiling point of 117° F. (47° C.) and can thus generate substantial positive pressure within an enclosed area at a relatively low and therefore safe temperature. It has a freezing point of −167° F. (−110° C.) and therefore has no practical limitation as to usage in cold areas. Should the light be broken with such impact that both the outer case and fluorescent tube be broken, the Halon under positive pressure would prevent flammable gases from coming into contact with the electrical components and instantly suppress any incipient source of ignition.

These characteristics also permit the light to be used in Class II and Class III hazardous areas.

SUMMARY OF THE INVENTION

Therefore, it is an object of the invention to provide an explosion proof light which contains its own internal supply of extinguishant.

It is another object of the invention to provide an explosion proof light which is lightweight and highly resistant to breakage.

It is another object of the invention to provide an explosion proof light which is portable and safe to use in areas where flammable gases or dusts are present.

These and other objects of the present invention are achieved in the preferred embodiments disclosed below by providing an explosion proof light comprising a shatter-resistant, fluid tight, light transmissive case and a fluid tight light source sealed within the case in at least partial spaced-apart relation thereto. An effective quantity of electrically non-conductive fluid extinguishant is sealed within the space between the case and the light source under positive pressure for suppressing sparks resulting from damage to the light causing penetration to the light source and exposure of sparks and intense heat to the environment.

According to one preferred embodiment of the invention, the light source comprises a fluorescent light source.

According to another preferred embodiment of the invention, the fluid extinguishant comprises Halon 2402.

According to yet another preferred embodiment of the invention, the case comprises a clear plastic tube, and the light includes an outer shatter-resistant outer housing positioned in closely surrounding relation to the case.

According to another preferred embodiment of the invention, the light comprises a shatter-resistant, fluid tight, light transmissive plastic tube and a fluid tight, light transmissive glass tube sealed within the case in at least partial spaced-apart relation thereto and containing a fluorescent light generating means. An effective quantity of electrically non-conductive fluid extinguishant is sealed within the plastic tube in the space between the plastic tube and the glass tube under positive pressure for suppressing sparks resulting from damage to the light causing penetration of the glass tube to the fluorescent light source and exposure of sparks to the environment.

According to one preferred embodiment of the invention, the fluid extinguishant comprises a fluid which exists in a liquid state at a temperature up to a point below the temperature of surface of the glass tube containing the fluorescent light generating means and in a gaseous state from at and above a point below the temperature of the surface of the glass tube containing the fluorescent light generating means for maintaining positive gaseous pressure during operation of the light.

According to yet another preferred embodiment of the invention, an alternating current power cord operatively is interconnected to the fluorescent light generating means for connection to an alternating power source, and a ballast operatively interconnected with the power cord.

Preferably, the outer light transmissive shatter-resistant outer housing is positioned in closely surrounding relation to the plastic tube.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
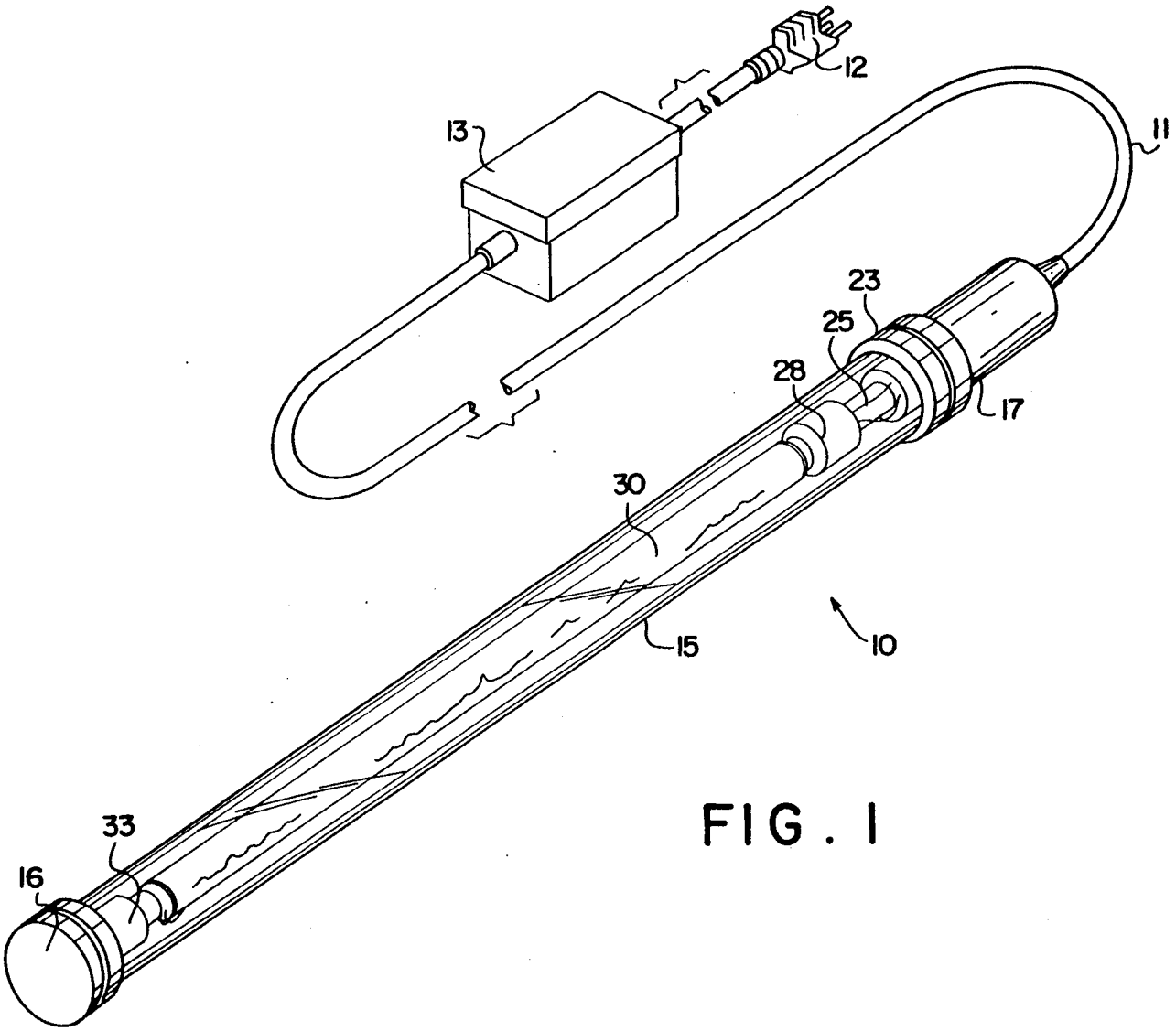
FIG. 1 is a perspective view of an explosion proof light according to one embodiment of the invention.

Referring now specifically to the drawings, an explosion proof light according to the present invention is illustrated in FIG. 1 and shown generally at reference numeral 10. The light 10 is powered by alternating current from a standard 120 V. current source by means of a long cord 11 which terminates in a conventional three blade grounded plug 12. A ballast 13 is wired into the cord 11 near the plug 12. Light 10 also includes a shatter-resistant, light transmissive outer housing 15 fabricated from, for example, polycarbonate or cellulose acetate butyrate, which provides excellent protection against impact breakage. In the embodiment shown in the drawings, housing 15 is in the shape of a tube, but other configurations are also possible.

Figure 2:
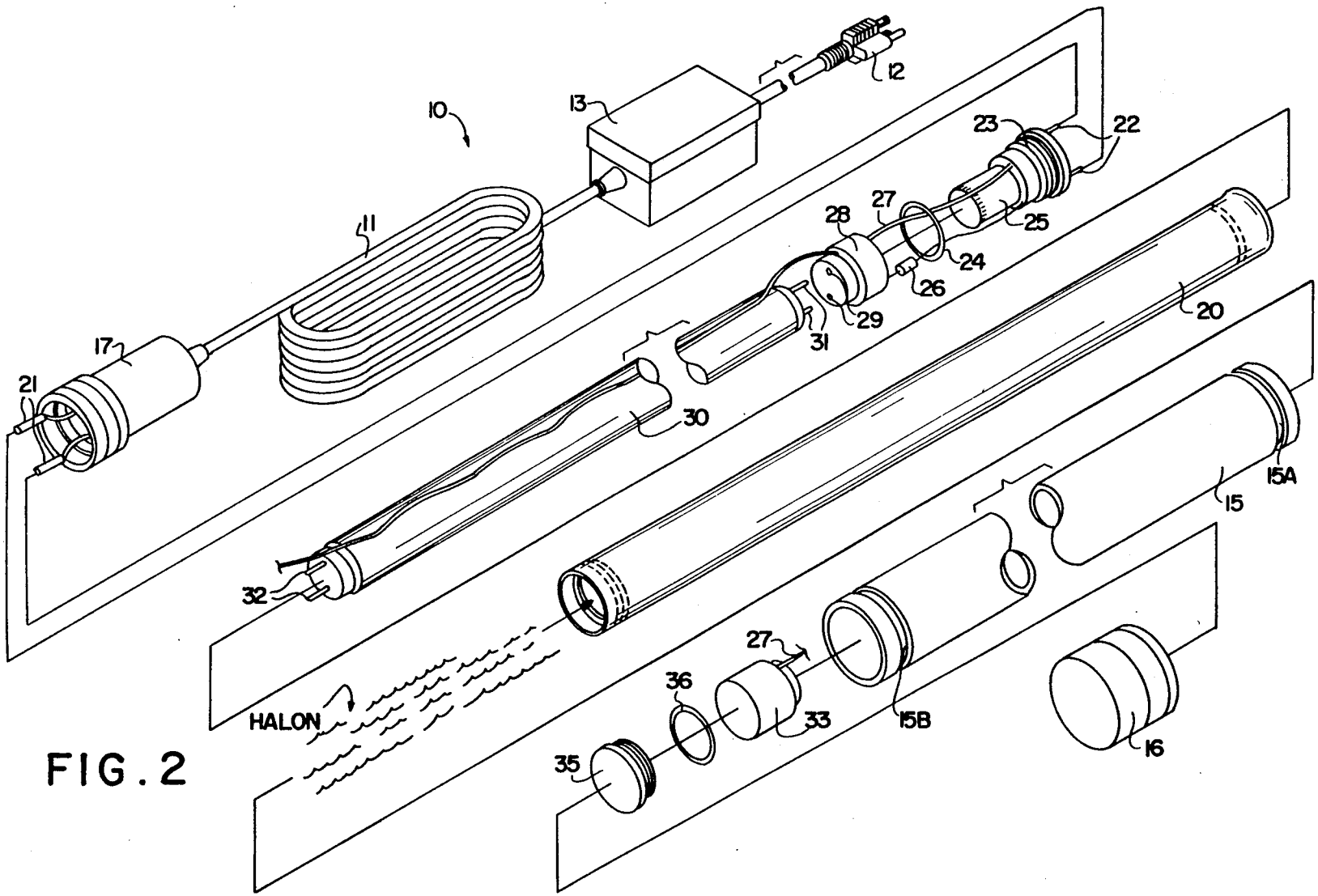
FIG. 2 is an exploded view of the light shown in FIG. 1.

Referring now to FIG. 2, housing 15 and the interior components of the light 10 are shock mounted in relatively soft rubber end caps 16 and 17. End caps 16 and 17 are held by a snap fit on housing 15 by means of an intergrally formed annular ring (not shown) formed on the interior of the end caps which snap into mating annular grooves 15A and 15B formed on opposite ends of housing 15 in its outer surface.

A tubular case 20, also fabricated from a tough, shatter-resistant material, preferably one of the polycarbonates such as Excelon R-4000 rigid polyvinylchloride (PVC) is sized to fit very closely within housing 15 and will slide out of housing 15 with almost no lateral movement. Excelon R-4000 is an excellent material for use because it is self-extinguishing, virtually transparent, very strong and has zero absorbtion of the preferred extinguishant Halon 2402.

In effect, the housing 15 and case 20 become a single, two ply shock absorbing and shatter-resistant outer shell. The operating elements of the light 10 are contained within the case 20. The outer housing 15 itself is not fluid or pressure tight.

Referring still to FIG. 2, end cap 17 connects with the power cord 11 through a hole in the end (not shown). The power cord 11 terminates in a pair of insulated female connectors 21 which are connected to a mating pair of male connectors 22 mounted in a plug 23. Plug 23 carries a sealing O-ring 24 and the plug 23 and O-ring 24 snap into a groove in case 20 and tightly seal one end of the case 20 against fluid loss.

A starter 25 is mounted on the interior end of plug 23 and is connected by wiring (shown only schematically as wiring 27) to a bulb socket 28. A fluorescent bulb light source 30, such as a General Electric 14 Watt cool white bulb (F14T8-CW) is plugged by male connectors 31 into insulated female connectors 29 in one end of bulb socket 28. This bulb has a rated life of 7500 hours—ten times the rated life of "rough usage" incandescent bulbs used in conventional explosion-proof light. Bulb socket 28 is sized to fit snugly but not sealingly into case 20. The opposite end of bulb 30 is plugged into a bulb socket 33 by male connectors 32. Bulb socket 33 is also sized to fit snugly but not sealingly into case 20. The bulb 30 has a smaller diameter than the bulb sockets 28 and 33 and as a result a volume is defined between the inner surface of the case 20 and the surface of the bulb 30.

The end of the case 20 adjacent bulb socket 33 is sealed by a plug 35 which snaps into a groove in case 20 and carries an annular O-ring 36 which fits tightly and sealingly against the inner wall of case 20. Therefore, a sealed container is defined by the case 20 and opposing plugs 23 and 35. The seal created by plugs 23 and 35 is extremely fluid and pressure tight. Any attempt to remove plug 23 or 35 will effectively destroy the unit. It is intended as a matter of safety that the user will be required to return the unit to the manufacturer for repair or replacement of components.

Figure 3:
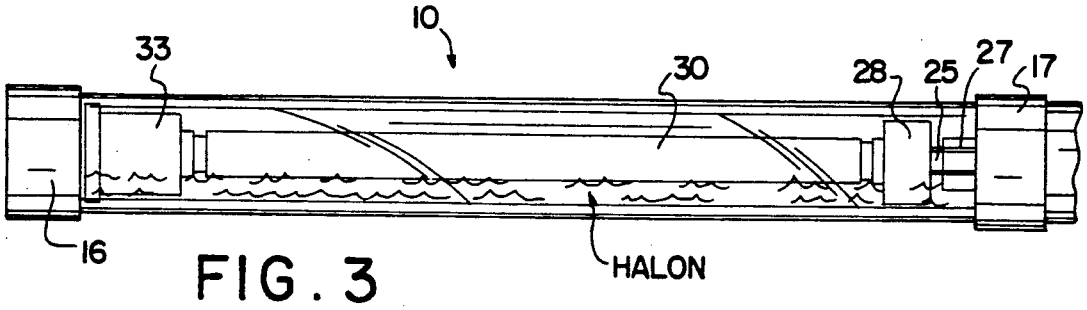
FIGS. 3, 4 and 5 are fragmentary views showing the fluid extinguishant sealed in the light.
Figure 4:
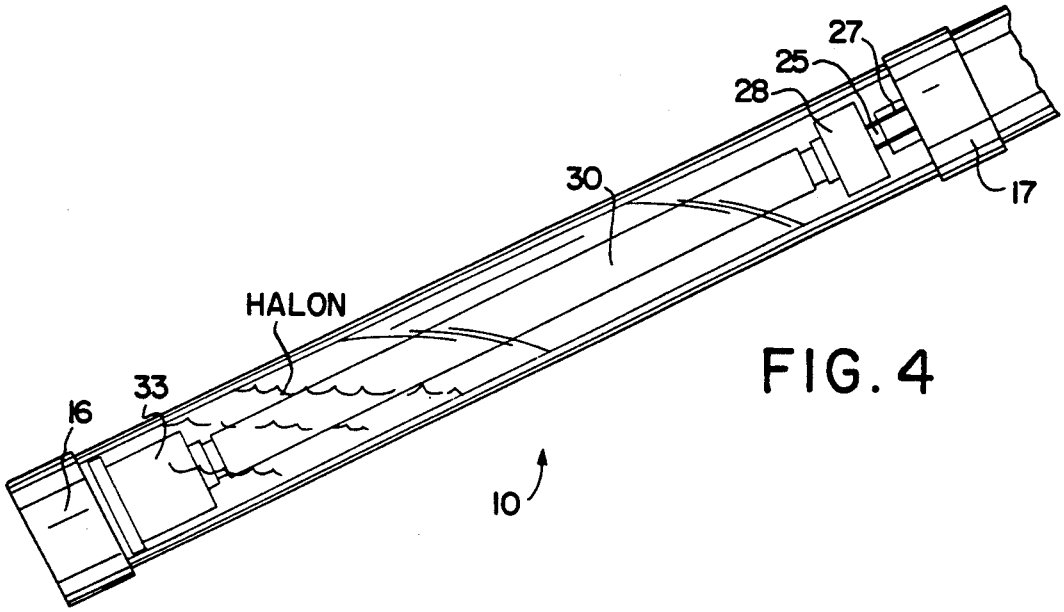
Figure 5:
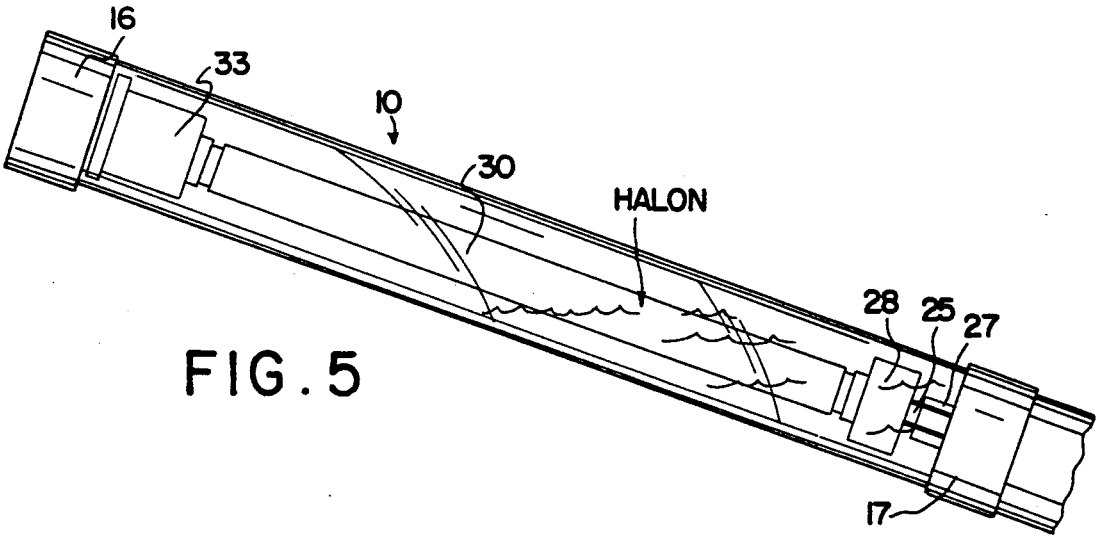

Within this sealed container is placed approximately one ounce of a fluid extinguishant, preferably Dibromotetrafluoroethane, commonly known as Halon 2402. This extinguishant has peculiar characteristics which make it ideal for use in this environment. It has relatively low toxicity and is completely inert. Even though the fluid extinguishant is free to flow around and through the components, including the wiring and the socket connectors, the extinguishant does not short the electrical circuit. The free-flowing capability of the extinguishant is illustrated in FIGS. 3, 4 and 5.

The extinguishant is placed within the case 20 in a chilled condition, for example 40° F. (3° C.) as a liquid, and as it expands to any environmental temperature above 40° F. (3° C.) a positive pressure is established within case 20, even though the extinguishant is still in liquid form. When the light is turned on, it heats up the interior of the case and the extinguishant. The extinguishant has a boiling point of approximately 117° F. (47° C.)—somewhat below the operating temperature of the light. The expansion of a portion of the extinguishant into a gaseous form increases the positive pressure within case 20. Only a portion of the Halon 2402 evaporates, leaving visible liquid in the case 20 as a visual check that the light has not leaked and it in condition for safe operation.

Halon 2402 has a very flat pressure curve. Between 70° F. (20° C.) and 140° F. (67° C.) only one atmosphere of pressure is generated within case 20. With an inside diameter of less than 1.375 inches (3.6 cm), pressure within case 20, less than 25 pounds (11.5 kg.) of total pressure is exerted on the plugs 35 and 23. Many times this force is required to dislodge these components.

Should light 10 be damaged to the extent that the housing 15 and case 20 and possibly the bulb 30 are broken, the extinguishant will expand out of the case 20 and housing 15 and effectively prevent any sparks within the light from contacting flammable gases of liquids in the environment. Since the extinguishant is under positive pressure whether the light is in operation or not, the extinguishant operates effectively under all conditions. In the event positive pressure in the light is lost, a safety pressure-sensitive switch 26 (FIG. 2) breaks the electrical circuit within the light and prevents it from operating.

Preferably, a reflective foil sheet (not shown) is inserted between the outer housing 15 and case 20 around approximately one-half of the circumference and along the length of the case 20. The reflective surface directs and intensifies the light onto the object to be illuminated. The outer side of the sheet is used for labeling, UL information and the like. In addition, hooks (not shown) can also be snapped around the outer sleeve to facilitate locating and focusing the light onto the work area and maintaining it at the proper position during work.

A less expensive version of light 10 can be constructed by omitting outer housing 15 and fitting smaller end caps directly onto case 20 which would have both inner and outer grooves to seat the end plugs and the outer end caps and handle.

An explosion proof light is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. An explosion proof lamp comprising:

(a) a shatter-resistant, fluid tight, light transmissive case;

(b) a fluid tight light source and electrical connector means of said light source sealed within said case in at least partial spaced-apart relation thereto; and (c) an effective quantity of electrically non-conductive liquid extinguishant sealed within the space between said case and said light source in liquid flow communication with said light source and said electrical connector means of said light source under positive pressure for suppressing sparks resulting from damage to the light causing penetration to the light source and exposure of sparks and intense heat to the environment, said liquid extinguishant comprising dibromotetrafluoroethane.

2. An explosive proof lamp comprising:

(a) a shatter-resistant, fluid tight, light transmissive case, said case comprising a clear plastic tube;

(b) an outer shatter-resistant outer housing positioned in closely surrounding relation to said case;

(c) a fluid tight light source and electrical connector means of said light source sealed within said case in at least partial spaced-apart relation thereto; ; and (d) an effective quantity of electrically non-conductive liquid extinguishant sealed within the space between said case and said light source in liquid flow communication with said light source and said electrical connector means of said light source under positive pressure for suppressing sparks resulting from damage to the light causing penetration to the light source and exposure of sparks and intense heat to the environment.

3. An explosion proof lamp according to claim 1 or 2, wherein said light source comprises a fluorescent light source.

4. An explosion proof lamp according to claim 2 wherein said liquid extinguishant comprises dibromotetrafluoroethane.

5. An explosion proof lamp according to claim 1 or 2, and including alternating current power cord operatively interconnected to said light source for connection to an alternating power source, and a ballast operatively interconnected with said power cord.

6. An explosion proof lamp comprising:

(a) a shatter-resistant, fluid tight, light transmissive plastic tube;

(b) a fluid tight, light transmissive glass tube and electrical connector means of said glass tube sealed within said tube in at least partial spaced-apart relation thereto and containing a fluorescent light generating means; and (c) an effective quantity of electrically non-conductive liquid extinguishant sealed within said plastic tube in the space between said plastic tube and said glass tube in liquid flow communication with said fluorescent light generating means and said electrical connector means of said fluorescent light generating means under positive pressure for suppressing sparks resulting from damage to the light causing penetration of the glass tube to the fluorescent light generating means and exposure of sparks to the environment, said liquid extinguishant comprising dibromotetrafluoroethane.

7. An explosion proof lamp comprising:

(a) a shatter-resistant, fluid tight, light transmissive plastic tube;

(b) an outer shatter-resistant outer housing positioned in closely surrounding relation to said plastic tube;

(c) a fluid tight, light transmissive glass tube and electrical connector means of said glass tube sealed within said tube in at least partial spaced-apart relation thereto and containing a fluorescent light generating means; and (d) an effective quantity of electrically non-conductive liquid extinguishant sealed within said plastic tube in the space between said plastic tube and said glass tube in liquid flow communication with said light source and said electrical connector means of said light source under positive pressure for suppressing sparks resulting from damage to the light causing penetration of the glass tube to the fluorescent light source and exposure of sparks to the environment, wherein said liquid extinguishant comprises dibromotetrafluoroethane.

8. An explosion proof lamp according to claim 6 or 7, and including alternating current power cord operatively interconnected to said fluorescent light generating means for connection to an alternating power source, and a ballast operatively interconnected with said power cord.

* * * * *